US007169229B2

(12) United States Patent
Gibson et al.

(10) Patent No.: US 7,169,229 B2
(45) Date of Patent: Jan. 30, 2007

(54) MOVING HEAD, COATING APPARATUS

(75) Inventors: Gregory M. Gibson, Dallas, TX (US); Carl W. Newquist, Plano, TX (US); John E. Hawes, Grapevine, TX (US); Rene Soliz, Dallas, TX (US); Samer Mahmoud Kabbani, Dallas, TX (US); Scott A. Snodgrass, Garland, TX (US); Altaf A. Poonawala, Flower Mound, TX (US); Darwin R. Frerking, Garland, TX (US); Zi-Qin Wang, Richardson, TX (US); Ocie T. Snodgrass, Garland, TX (US); Eric E. Anderson, Dallas, TX (US)

(73) Assignee: FAStar, Ltd., Dallas, TX (US)

( * ) Notice: Subject to any disclaimer, the term of this patent is extended or adjusted under 35 U.S.C. 154(b) by 43 days.

(21) Appl. No.: 10/364,537

(22) Filed: Feb. 11, 2003

(65) Prior Publication Data

US 2003/0111011 A1 Jun. 19, 2003

Related U.S. Application Data

(62) Division of application No. 09/227,667, filed on Jan. 8, 1999, now Pat. No. 6,540,833.

(60) Provisional application No. 60/070,985, filed on Jan. 9, 1998, provisional application No. 60/070,984, filed on Jan. 9, 1998, provisional application No. 60/070,983, filed on Jan. 9, 1998.

(51) Int. Cl.
*B05C 3/02* (2006.01)

(52) U.S. Cl. ..... 118/410; 118/323

(58) Field of Classification Search ..... 239/332, 239/104, 119, 124, 127; 222/255, 383.1, 222/386.5, 339, 334, 481.5; 92/96; 137/565.3; 425/376.1, 812, 203, 382.3; 118/410, 323, 118/683, 679; 417/383, 395; 366/75; 264/102
See application file for complete search history.

(56) References Cited

U.S. PATENT DOCUMENTS

| | | | | |
|---|---|---|---|---|
| 2,413,851 | A * | 1/1947 | Taylor | 417/199.1 |
| 2,959,131 | A * | 11/1960 | Shoosmith | 417/383 |
| 3,000,320 | A * | 9/1961 | Ring | 417/383 |
| 3,072,462 | A * | 1/1963 | Anderson | 422/131 |
| 3,080,820 | A * | 3/1963 | Browne | 417/347 |
| 3,649,147 | A * | 3/1972 | Fritsch | 425/170 |
| 3,787,160 | A * | 1/1974 | Leister | 425/208 |
| 4,424,178 | A * | 1/1984 | Daubenbuchel et al. | 264/40.1 |
| 4,430,048 | A * | 2/1984 | Fritsch | 417/383 |
| 4,597,719 | A * | 7/1986 | Tano | |
| 4,822,269 | A * | 4/1989 | Kamiyama et al. | 425/203 |
| 4,938,994 | A * | 7/1990 | Choinski | 427/96.1 |
| 5,000,112 | A * | 3/1991 | Rothen et al. | |
| 5,002,800 | A * | 3/1991 | Uehara et al. | 427/209 |
| 5,046,666 | A * | 9/1991 | Ono | |
| 5,266,247 | A * | 11/1993 | Yokota | 264/40.4 |
| 6,054,077 | A * | 4/2000 | Comb et al. | |
| 6,582,206 | B2 * | 6/2003 | Schluecker | 417/395 |

* cited by examiner

*Primary Examiner*—Brenda A. Lamb
(74) *Attorney, Agent, or Firm*—Winstead Sechrest & Minick, P.C.; Henry L. Ehrlich

(57) ABSTRACT

The invention pertains to a coating apparatus and method in which most of the relative movement between a dispensing head and the substrate to be coated is provided by the coating head. The moving head configuration reduces the system footprint and diminishes leveling problems. A powered shuttle mechanism carries a dispensing head above a substrate to be coated while riding on a bearing located underneath the chuck holding the substrate thereby providing rigidity and reducing the system footprint. Chuck support is designed to accommodate anticipated vertical sag in the dispensing head by supporting the chuck at points along its periphery thereby permitting the chuck to sag in conjunction with the dispensing head. The shuttle mechanism is equipped with means for automatically adjusting the height of the dispensing head with respect to substrate to compensate for substrate placement error, substrate dimensional variation, and mechanical drift in the mechanical machine parts. Coating consistency is enhanced using such height adjustment. A part of the apparatus containing the fluid delivery equipment and in communication with the dispensing head may be placed on a cart and removably attached to the rest of the apparatus. There is a utility station comprising equipment for cleaning and priming the dispensing head which may be located on the removable cart. A pump in addition to main remote pumping means may be integrally mounted on the dispensing head to more precisely control fluid flow to the dispensing head. The chuck may be configured to be micro deformable so as to maintain the surface of a substrate upon it at a constant height. Fluid may be dispensed along openings of selected lengths along the length of the dispensing head using die lips attached to the dispensing head or by cutting a plurality of slots in a single dispensing head.

18 Claims, 11 Drawing Sheets

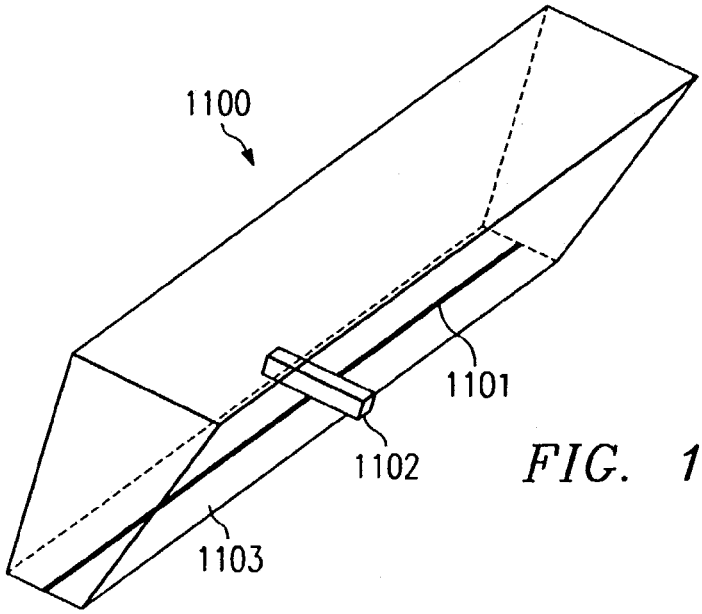
FIG. 11
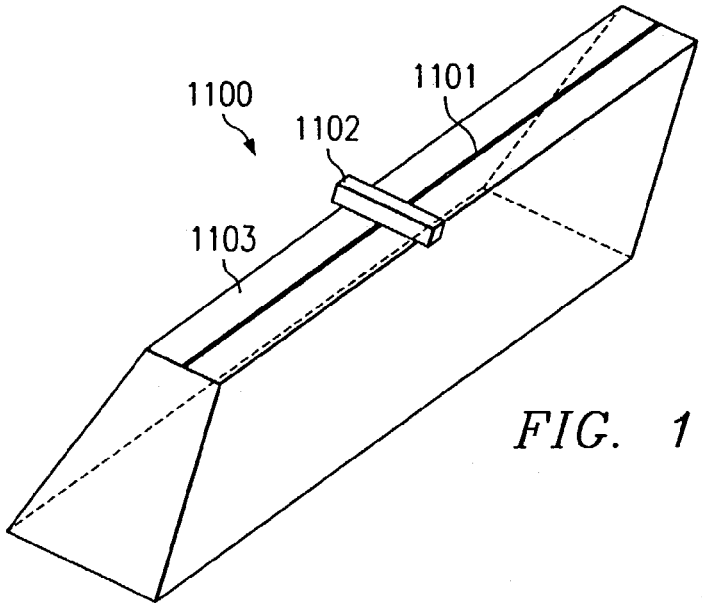
FIG. 11A
FIG. 12
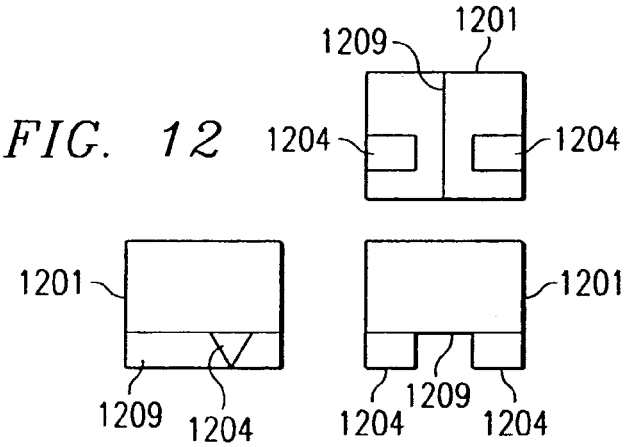

MOVING HEAD, COATING APPARATUS

REFERENCE TO RELATED APPLICATIONS

This application is a divisional application and claims benefit of priority of U.S. Ser. No. 09/227,667, now U.S. Pat. No. 6,540,833, filed Jan. 8, 1999 entitled blank MOVING HEAD, COATING APPARATUS AND METHOD, which is incorporated herein by reference, which claimed the benefit to U.S. Provisional Application Ser. No. 60/070,985 filed Jan. 9, 1998, entitled INTELLIGENT CONTROL SYSTEM FOR EXTRUSION HEAD DISPENSEMENT; Provisional Application Ser. No. 60/070,984 filed Jan. 9, 1998, entitled EXTRUSION COATING SYSTEM FOR SEGMENTED COATING USING DIE LIPS and Provisional Application Ser. No. 60/070,983 filed Jan. 9, 1998, entitled MICRO DEFORMING CHUCK, the disclosures of which are incorporated herein by reference.

U.S. Pat. No. 6,540,833 is related, and reference hereby made to commonly assigned patent applications: Ser. No. 09/227,692, now U.S. Pat. No. 6,475,282, entitled INTELLIGENT CONTROL SYSTEM AND METHOD FOR EXTRUSION HEAD DISPENSEMENT; Ser. No. 09/227,362, now U.S. Pat. No. 6,092,937, entitled LINEAR DEVELOPER; Ser. No. 09/226,983, now U.S. Pat. No. 6,387,184, entitled SYSTEM AND METHOD FOR INTERCHANGEABLY INTERFACING WET COMPONENTS WITH A COATING APPARATUS; Ser. No. 09/227,381, now U.S. Pat. No. 6,488,041, entitled METHOD FOR CLEANING AND PRIMING AN EXTRUSION HEAD; and Ser. No. 09/227,459, now U.S. Pat. No. 6,319,323, entitled SYSTEM AND METHOD FOR ADJUSTING A WORKING DISTANCE TO CORRESPOND WITH THE WORK SPACE, the disclosures of which applications are incorporated herein by reference.

The present application is also related, and reference hereby made, to previously filed, and commonly assigned patent applications: Ser. No. 09/148,463, now U.S. Pat. No. 6,495,205, entitled LINEAR EXTRUSION COATING SYSTEM AND METHOD; and Ser. No. 09/201,543, now U.S. Pat. No. 6,548,115, entitled SYSTEM AND METHOD FOR PROVIDING COATING OF SUBSTRATES.

TECHNICAL FIELD

This invention relates to the precision coating of surfaces and more particularly to extrusion coating of substrates using a configuration wherein a coating head moves across a substrate.

BACKGROUND

It is often necessary or desired to provide a precision coating of a particular substrate such as a glass panel. For example, in the video electronics industry it is often desired to coat panels which will serve as flat panel displays (FPD) to be incorporated into television sets, computer monitors and the like. It is important in such applications to ensure the accuracy and consistency of coating thicknesses across the panel.

A commonly employed method of coating flat panel displays is to have a stationary head extruding fluid at a particular rate over linearly moving panels. Using such a configuration, the coating consistency is dependent upon a number of parameters such as the gap between the head and the panel surface, the variation in this gap as the panel moves, the dimensional consistency of the panel, the mechanical tolerances of the extrusion orifice or slot, the pump characteristics, and the presence of gas or air bubbles in the coating material. Additional factors affecting variation in the thickness in the coating across the area of the panel will be the consistency of fluid flow rate through the extrusion head, and the consistency of linear velocity of the panel under the head as well as the ability to maintain steady movement, as measured in each of the x, y and z planes, of an often large substrate. The above all represent problems in the art.

In the context of this discussion, the length of the dispensing head refers to the span of the head, generally in a direction perpendicular to the coating direction. This "length" of the dispensing head may correspond to the same direction as the width of the substrate to be coated, since the dimension of the substrate concerned may in fact be the shorter of the two horizontal dimensions of said substrate. In addition to the considerations of distance between various key elements is the issue of vertical flexing in a extrusion head across its own length. The extent of this problem will depend upon the nature of the support structure for the head as well as the length and density of the head structure. To the extent that such vertical flexing is present, it presents the problem of variation in height between the head and the panel along the length of the head.

The moving panel approach requires a large footprint for the overall mechanism because there must be at least enough space set aside for the full area of the panel on both sides of the fluid extrusion means. There is also a need for leveling the panel throughout its travel underneath the extrusion means. Further, the disadvantages of a large footprint requirement and leveling issues increase as the size of the panel increases. Therefore, it is problem in the art that the system footprint must be at least double the area of the panel to be coated. It is also a problem in the art that there could be variation in height between the head and the panel along the length of the panel.

In order to avoid dripping or smearing coating material which has gathered around the extrusion head after a coating operation, it is often necessary to clean the extrusion head before a new coating operation begins. In the prior art, cleaning of extrusion mechanisms is usually accomplished manually, potentially leading to inconsistent results and disruption and delay of the coating operations. Therefore, it is a problem in the art that manual cleaning operations are inconsistent and unreliable.

In order to ensure that coating material is applied consistently and evenly right from the start of the coating operation, it is desirable to ensure that a bead is fully and properly formed at the extrusion head prior to starting the coating process. A problem in the prior art exists with respect to properly priming fluid extrusion heads so as to ensure that a proper bead is formed prior to extruding fluid over the panel, and that a consistent rate of coating fluid flow is thereafter achieved as the full area below the extrusion head must be maintained open for the passing of a substrate thereunder, thus making it difficult to provide any priming mechanism.

Generally, in prior art coating systems, there is a single pump mechanism located remotely from the extrusion head with appropriate fluid conducting means leading from the pump to the head. The use of a single pump, while perhaps economical, makes it difficult to precisely control fluid flow at the extrusion head. Specifically, it may be difficult to start and stop at precisely defined moments and to establish the precise fluid flow rate desired. Some prior art systems have used two pumps.

In the prior art, the fluid delivery means, including fluid supply, pumps, and fluid extrusion head assembly were all part of a single integrated coating apparatus assembly. As such, when it was necessary to change coating fluids, or perform other operations on the fluid delivery means, the entire coating apparatus would be idled. Fluid changeover operations include time consuming tasks such as cleaning all tubing, pumping mechanisms, and essentially all surfaces where residue of the previous coating material could be present. This thoroughness is necessary because of potentially dangerous chemical reactions between two different coating materials to be used in succession, and the possibility of cross-contamination between materials used in different processes. The idle time for the coating apparatus is expensive and wasteful given that mechanisms unrelated to the fluid delivery system are idled by the operations necessary for fluid changeover. Accordingly, a need exists in the art for a system and method wherein a chuck assembly adapted to position and hold substrates to be coated as well as other components and materials used in the coating process, but not part of the fluid delivery system are not left idle during fluid delivery system cleaning operations.

In prior art systems, variation in the height of the extrusion head with respect to the panel can cause breaking of the coating bead and variation in coating thickness. The causes of such height variation include part dimension variation, part placement error, and gradual drift in machine dimensions over time. Accordingly, there is a need in the art for a system and method for ensuring constant extrusion head height over the panel being coated.

Accordingly, a need exists in the art for a system and method for providing a uniform coating of a desired thickness on a relatively large substrate, including panels of various shapes and sizes, while providing efficient use of a coating material.

A still further need exists in the art for a system and method for coating substrates which will minimize the footprint of the coating system.

A still further need exists in the art for a system which is adaptable to very large substrate sizes.

A still further need exists in the art for a system in which a constant extrusion head gap is maintained irrespectively of flex associated with the use of a linear extrusion head.

A still further need in the art exists for a cleaning station whose functions are easily accessible to a fluid dispenser such as an extrusion head at appropriate times such as between coating operations.

A still further need in the art exists for a priming station which can be accessed easily by a fluid dispenser such as an extrusion head at appropriate times such as between coating operations.

A still further need in the art exists for more precisely controllable flow of coating material at a fluid dispenser such as an extrusion head.

SUMMARY OF THE INVENTION

These and other objects, features and technical advantages are achieved by a system and method which utilizes extrusion or other controlled delivery process to precisely place a coating material on a substrate. Preferably, the coating delivery system includes a, preferably stationary, substrate holding or positioning mechanism and a shuttle mechanism carrying a fluid delivery device across the entire length of the substrate while spanning the width of the substrate.

In the context of this discussion, the length of the dispensing head refers to the span of the head, generally in a direction perpendicular to the coating direction. This "length" of the dispensing head may correspond to the same direction as the width of the substrate to be coated, since the dimension of the substrate concerned (the one parallel to the span of the dispenser) may in fact be the shorter of the two horizontal dimensions of said substrate. This explanation is offered to avoid any possible confusion arising from use of the terms "width" and "length" in the following and is not intended to limit the scope of the invention.

The preferred embodiment of the substrate positioning mechanism utilizes a chuck which holds a substrate in place adapted to allow a shuttle mechanism transporting a fluid dispenser to traverse the full length of the substrate to be coated. It is easily recognized that a lower bound on the footprint of a substrate coating system according to the present invention is the area of the substrate itself. Using the configuration of the present invention, the footprint of the apparatus in the horizontal plane is much reduced with respect to a configuration in which the substrate travels a distance equal to its own length underneath a fluid dispenser. In the present configuration, the length of the system need only exceed the length of the substrate by the amount necessary for the fluid dispensing mechanism to move clear of the substrate, for purposes of substrate placement and removal, and possibly for the placement of utilities to service the fluid dispenser in between coating operations.

The configuration of the present invention is adaptable to large substrate sizes as the nature of the chuck assembly design would change little with increasing substrate size. A single coating apparatus can be used with substrates of different sizes by employing a head of appropriate length and ensuring that the shuttle mechanism has sufficient travel to cover the lengths of the various substrates to be coated.

Where a larger substrate cannot be accommodated by a particular coating apparatus, the principal changes required for such apparatus required for a larger substrate size would be to appropriately increase either the width and/or travel of the shuttle mechanism and length (or "span") of the fluid dispenser, and to adjust the size of the chuck. Alternatively, where the increased size of the substrate results from an increased length, the present invention may be adapted to provide sufficient movement of the chuck to allow the combination of moving head and moving chuck to fully coat the substrate without significantly increasing the footprint of the coating system. Accordingly, in an alternative embodiment, a substrate chuck movable between first and second positions moves the substrate to cooperate with the above described mount of the fluid delivery head to provide a uniform coat of fluid to the substrate.

A shuttle mechanism which carries the fluid dispenser preferably rides on an air bearing or alternative precision support and guidance mechanisms such as rolling contact with a rail system, or low friction contact surface, located underneath the chuck assembly, the shuttle mechanism thereby forming a single continuous rigid loop structure when a fluid delivery apparatus such as an extrusion head is engaged therein. The rigidity of this design optimizes the precision with which the coating apparatus can operate. This configuration also minimizes the width of the apparatus by obviating the need for a support surface beyond the width of the chuck assembly, thereby further reducing the footprint of the coating apparatus. However, the shuttle mechanism, with its air bearing below the chuck, a carriage to carry the fluid dispenser above the chuck and substrate, and structural links connecting the two, effectively envelops the chuck thereby restricting the permitted thickness of the chuck assembly and equipment contained therein. In an alternative embodiment, the air bearing or other support and guidance mechanisms may be located to the side of the chuck assembly.

A component of the preferred embodiment chuck is a lift plate mechanism which lowers and raises the substrate within the chuck for the purposes, respectively, of loading of substrates onto the chuck, and removing substrates from the chuck. The above described constraint on the vertical dimension of the chuck forces the lift plate mechanism to accomplish the required vertical displacement of the substrate while minimizing the height of the mechanism. This is accomplished in a preferred embodiment by using motion in a direction not so tightly constrained such as by horizontally displacing diagonal wedges toward rollers attached to vertically oriented lift pins, thereby causing the pins to displace vertically as the wedges move horizontally. Once loaded into the chuck, the substrate is preferably held in place by a standard vacuum mechanism, or by alternative mechanisms including but not limited to clips, clamps, or detents. The horizontal displacement of the wedges toward the roller-based pins can be accomplished by a number of means including relay activated air cylinders, electromagnetic coils, electric motors, or by hydraulic action.

When using the shuttle arrangement described above, wherein the fluid dispenser is supported thereby such as at both ends, the fluid dispenser may flex vertically at any given point between the points of support by an amount roughly proportional to the distance of such point from the nearest support.

Accordingly, the preferred embodiment chuck is adapted to hold the substrate with a corresponding amount of flex. A chuck holder is preferably used to provide the chuck, and therefore the substrate, with the desired amount of flex. In a preferred embodiment, the chuck holder comprises a frame, structure, preferably including a provision for adjusting the dimensions of the chuck holder, suspended above the shuttle mechanism transport surface, and attached to the coating apparatus, at a plurality of points preferably just outside the range of travel of the shuttle mechanism so as to minimize the system footprint. The chuck holder preferably further comprises a plurality of chuck supports, preferably movable along the structure, which will interface with the chuck when the chuck is placed on the chuck holder.

The geometry of the suspended frame structure and the location of the chuck supports are such as to support the chuck at its edges and preferably not under its center. This arrangement is designed to permit the chuck and any substrate placed upon it to flex vertically along the axis perpendicular to shuttle mechanism travel. This vertical flexing is intended to match the vertical flexing along this same axis expected in the dispensing head.

In a preferred embodiment of the present invention, utilities for servicing the fluid dispensing head may be located within the range of travel of the fluid dispensing head as carried by the shuttle mechanism. With such an arrangement, the shuttle can be automatically programmed to stop at these utilities in between coating operations or at other appropriate times. A set of utilities could include a scrubbing station at which bulk coating material would be removed from the dispensing head through a combination of physical scrubbing with brushes in combination with use of a solvent.

Another operation among these utilities could consist of a rinsing station at which a powerful solvent removes any material remaining from the most recent coating operation, even if the dispenser has been cleaned at the scrubbing station. Yet another operation among these utilities could consist of a priming station at which the dispensing head could be placed so as to ensure that a full and consistent bead of coating fluid is made ready at the dispensing head in preparation for the next coating operation. A preferred embodiment for such a priming station consists of rotating cylinder upon which coating fluid is placed in the smallest quantity necessary to establish a consistent bead. In this embodiment, holding the dispensing head stationary in proximity to the rotating cylinder effectively simulates moving the dispensing head over a certain length of surface material.

In a preferred embodiment of the present invention, a primary pump located remotely from the dispensing head would pressurize the fluid connections leading up to a dispensing head assembly, and a second smaller pump, integrated into the dispensing head assembly, is able to precisely control the dispensing of fluid from the dispensing head. In an alternative embodiment, a single pump can be used to perform all required fluid pumping functions within the apparatus.

In a preferred embodiment of the present invention, the fluid supply, pumping means, fluid dispensing head and utility stations would all be located on a cart removably attached to a main operating station containing the chuck and shuttle mechanism. Upon attaching the cart to the operating station, the shuttle mechanism would be attached either manually or automatically to the dispensing head which initially resides on the cart. The shuttle mechanism then, preferably under computer control, is able to move the dispensing head to the previously discussed utility stations, over the full length of the substrate to be coated, and when ready, back to the appropriate place on the removable cart.

With such an arrangement, each cart may be associated with a particular fluid or with a particular size or type of head. When a cart becomes unusable either because the fluid supply has been exhausted, becomes unusable due to degradation over time, or because the current manufacturing process requires using a different coating fluid, the used cart can be readily and rapidly disconnected from the main operating station. A new cart can then be immediately attached to the main station, and the shuttle mechanism again attached to the fluid dispensing head on the new cart. Coating operations can thus quickly resume without waiting for the time consuming task of cleaning and readying for operation the fluid system on the old cart. With this embodiment, the old cart can be cleaned and prepared for renewed operation in parallel with the resumption of coating operations at the very same main operating station. The idle time experienced in the systems of the prior art is thereby avoided.

In a preferred embodiment of the present invention, there is provision for real time sensing and adjustment of the height of the dispensing head with respect to the substrate being coated. Maintaining a constant height is critical to maintaining a good bead, and providing a continuous and consistent coating across the entire substrate. Variation in the height of the dispensing head over the substrate can result from variation in physical dimensions of the substrate, warpage of the substrate, or part positioning error.

An independent contributor to possible variation in the height of the dispensing head with respect to the substrate stems in fact from variation of the height of the shuttle mechanism mounting platform with respect to the chuck, that is to say a variation in machine dimensions rather than just variations in part placement and part dimensions. This variation in machine dimensions can result from a slow drift in mechanical dimensions over time, such as from the gradual bending of metal parts, wearing of certain surfaces, and thermal effects.

Height variation from either or both of the above sources can be addressed by employing a height sensor feeding information to a control system which activates a motor to drive the dispensing head higher or lower as the sensing data dictates. The height sensor is taught an appropriate "zero" point representing the correct height of the dispensing head, and any subsequent deviation from that point results in an error signal causing the control system and motor to correct the dispensing head's height. Preferably, the rate of adjustment in the height of dispensing head is tempered so as to ensure that an extrusion bead will not be broken. Sensing methods available for this purpose include but are not limited to mechanical contact sensing, preferably with roller contact, optical, air cushion, and ultrasonic.

In a preferred embodiment of the present invention, variation in the planar consistency of the substrate is compensated for through deployment of a micro deforming chuck. Preferably, the micro deforming chuck is composed of a rigid lower layer, semi-rigid upper layer, and a middle layer composed of piezoelectric crystals or other micro-deforming means. Raising and lowering the voltage applied to the piezoelectric middle layer permits this middle layer to be raised and lowered at strategically selected points so as to make the height of the upper level of the substrate uniform across the substrate. Further flexibility can be added by enabling three axes of motion to the chuck to provide for greater adjustment of surface levels than possible with micro-deformation of the chuck alone.

In another preferred embodiment of the present invention, fluid exits from a dispensing head only along selected portions of its length, thereby enabling segment coating. Segment coating is the ability to form multiple devices adjacent to each other on a substrate so as to obtain a matrix of devices which can be separated after liquid deposition. Unlike other coating techniques such as spin coating, extrusion coating is better suited to perform segmented coating since it directly deposits precise layers of subject fluid. At this time, there have been no successful attempts at segment coaters in the industry. The ability to segment coat a substrate is a critical step in the technology since it can reduce the number of runs by producing two segments at once, and it can make the use of larger areas of substrate more efficient.

In particular, there have been no adequate systems for handling large area substrates which will supply multiple displays or devices. In addition to the difficulties of obtaining an even surface, the throughput time of the coating equipment is very important. Throughput of a coating module is determined substantially by the length of the coated area divided by the linear rate of coating. Obtaining a throughput time that effectively allows for coating of a large area substrate has not been accomplished in the prior art.

There remains a long-felt need in the industry to more efficiently dispense subject fluid onto a substrate so as to form multiple devices on a single substrate. Segmenting the deposition of coating fluid in this manner permits separate coating fluid streams to be deposited onto separate substrates or separate portions of a common substrate without interfering with one another during deposition. One approach to segmenting fluid deposition involves placing a die lip over the dispensing head orifice. Each die lip is a separate part which is removably attachable to the dispensing head. The die lips of fluid delivery extrusion heads may have extrusion orifices of varying lengths to accommodate the substrates and/or fluids which are to be processed. Such an arrangement can permit a variety of different substrates of potentially varying dimensions to be processed in one sweep of the dispensing head thereby optimizing the production efficiency. Alternatively, segment coating can be achieved by using dispensing heads which may be extrusion heads with a plurality of extrusion orifices in them to permit fluid to exit from a plurality of slots rather than along the full length of the dispenser.

A further inventive mechanism comprises a control system combined with multiple extrusion head and pump mechanisms for applying a uniform and segmented layer of liquid to a substrate, preferably a large area substrate. In its preferred embodiment, the extrusion heads include a liquid-containing chamber and dispensing slots in communication with the chamber. A pump, integrally mounted to the extrusion head itself, provides a steady-state fluid flow of liquid to the slots on the extrusion head. Valves between the slots and the chamber control the dispensing flow so as to allow for differences in adjacent segments. The integrally mounted pumping means enables precision control of flow conditions within the head in a manner that avoids transient perturbations during initial extrusion startup. Fluid is supplied to the pump from a fluid supply bay remotely located from the pump. The fluid supply bay includes a supply pump, a fluid reservoir and means for filtering the fluid.

In a preferred embodiment the control system of the coating apparatus of the present invention consists of an adaptive type control unit, such as a neural network system. For example, there may be a pressure sensor within each head manifold and a vision sensor on the substrate chuck as well as a vision sensor for each of the bead formers on the extrusion head, preferably CCD cameras. The process control system can also be extended to monitor other attributes such as the steady state flow from the pumping means to the extrusion head. Accordingly, the control system may analyze and/or store empirical data in order to adaptively operate the systems of the coating apparatus to provide a desired coating on a substrate.

Accordingly, it is a technical advantage of the present invention that the moving head configuration minimizes the footprint of the coating apparatus.

It is a further technical advantage of the present invention that the coating apparatus is adaptable to very large substrate sizes, including for example, 1200 mm by 1600 mm.

It is a still further technical advantage of the present invention that the substrate to be coated will flex vertically in conjunction with vertical flex in the coating head so as to minimize the variation in distance between the head and the substrate along the length of the coating head or dispensing head.

It is a still further technical advantage of the present invention that the substrate to be coated can be accepted into, and presented for removal from, the coating system while minimizing the thickness of the chuck holding the substrate.

It is a still further technical advantage of the present invention that a plurality of means is provided with which to accomplish segment coating which can be applicable to coating a plurality of substrates at once.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which:

FIGS. 11 and 11A show perspective views of the segmented die lip;

FIG. 12 depicts multiple views of the extrusion head module;

DETAILED DESCRIPTION

In understanding the concepts and features of the present invention, reference to specific embodiments is helpful. Accordingly, description of various preferred embodiments of the present invention are provided herein. However, it shall be appreciated that the present invention is not limited to the specific embodiments disclosed herein.

The present invention is described in the context of depositing a coating on a surface of a variety of devices including but not limited to flat panel displays and integrated circuit substrates. The process liquid may be a photo resist, developer, etchant, chemical stripper, solder mask, or any other liquid chemical used in the manufacture of microelectronics devices such as integrated circuits, flat panel displays and the like, as well as other very sophisticated devices such as multi-chip modules (MCMs) and high density interconnect (HDI) chips used in mainframe computers, telecommunication switching systems, military electronics and other high-end devices. The present invention is not limited to any particular coating liquid, substrate or end product, and the principles of the invention should be broadly construed to be useful with any substrate and coating material suitable for use with any extrusion coating application.

Figure 1:
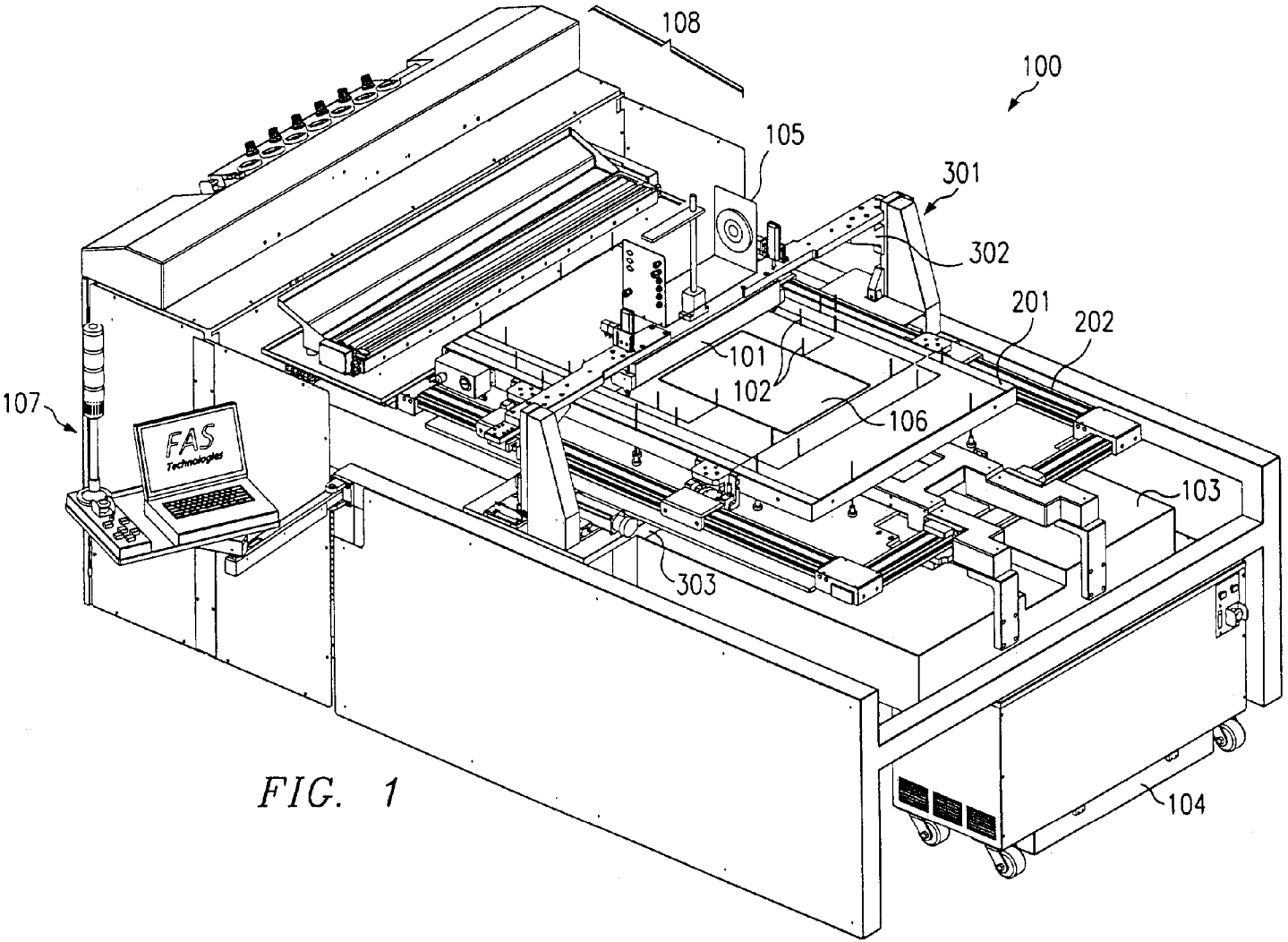
FIG. 1 depicts an isometric view of the overall moving head coating apparatus according to a preferred embodiment of the present invention.

FIG. 1 depicts an isometric view of the coating apparatus 100 according to a preferred embodiment of the present invention. A motion interface 103 which is preferably a bearing mechanism which could be an air slide made of granite or other hard rigid material, but alternatively could comprise a rail system with frictional or rolling contact, or electromagnetic suspension or the like, forms a foundation along which the shuttle mechanism or transport system 301 travels for cleaning, priming, and coating operations. The fluid equipment station 107 is preferably at one end of the air slide 103 in order to allow servicing of an extrusion head while clear of the coating working area of coating apparatus 100. The electrical control unit 104 is shown at the other end of air slide 103, although other placements are possible.

The fluid equipment station 107 may include a utility station 108. The utility station may include facilities for servicing an extrusion head and/or its attendant components, such as scrubbing, rinsing, and priming the dispensing head 101.

A chuck 201 is preferably suspended above the air slide 103 to allow the shuttle air bearing 303 to pass beneath and thus dispensing head 101 above the chuck. Chuck 201 provides support and positioning of substrate 106, which is to be provided a coating according to the present invention.

In a preferred embodiment of this invention, chuck holder 202 comprises a structure which will preferably support the chuck 201 principally at a plurality of points around the periphery of the chuck 201, so as to permit the chuck to flex vertically downward at points removed from the points of support on the chuck 201. This arrangement is designed so as to permit the flex in the chuck and correspondingly in the substrate to match the flex in the dispensing head along its own length. Variation in chuck 201 and substrate 106 height resulting from this support arrangement in the direction of travel (i.e. perpendicular to the axis of the dispensing head) can be compensated for, in the preferred embodiment, by the height adjustment capability built into the shuttle mechanism.

The preferred embodiment shuttle air bearing 303 of shuttle mechanism 301 rides along air slide 103 underneath the chuck 201, while the dispensing head 101 moves above the chuck 201 supporting substrate 106. The dispensing head is preferably a linear extrusion head attached to fluid manifold preferably containing a bead forming orifice substantially as described in U.S. Pat. No. 4,696,885, titled "METHOD OF FORMING A LARGE SURFACE AREA INTEGRATED CIRCUIT."

The travel of the shuttle mechanism 301 preferably will be at least long enough to permit the dispensing head 101 to completely coat the largest substrate to be placed on the apparatus 100 and to clear the substrate by a sufficient distance to permit the substrate to be removed by external personnel or machinery. Although this range may be reduced by providing for some movement of the substrate during coating. The travel of the shuttle mechanism 301 will preferably also be long enough so that in addition to clearing the substrate 106, the shuttle mechanism will be able to gain access to utility station 108.

Substrate 106 is preferably raised from chuck 201 prior to removal of substrate 106 from coating apparatus 100 preferably using substrate lift pins 102 located underneath the substrate surface. Alternatively, substrate 106 may be raised from chuck 201 for removal such as by reversing the vacuum in the chuck, gliding or rotating devices under the substrate to raise the substrate, or by lifting a portion of the substrate which protrudes beyond the surface of chuck 201 or the like.

In order to minimize the system footprint, and to improve coating performance, particularly on the leading edge of a substrate (starting point for the coating operation), substrate 106 is located as close as possible to utility station 108 in the preferred embodiment. Preferably, the shuttle mechanism 301 carries the dispensing head 101 to the utility station 108 for head cleaning and for priming of the bead either before or during the loading of the substrate 106. Shuttle mechanism 301 then preferably carries the dispensing head 101 to the near edge of the substrate 106 (the side closest to the fluid equipment station 107) so that coating of the substrate 106 may begin. The shuttle mechanism 301 then carries the dispensing head 101 across the substrate at a carefully monitored and predetermined rate, preferably under computer control, while the dispensing head 101 dispenses coating material at a controlled rate onto the substrate 106. Once the shuttle mechanism 301 has traveled to a point where the dispensing head 101 has coated the entire substrate 106 or that portion to be coated, fluid flow to the dispensing head 101 is discontinued. Substrate 106 may then be removed prior to moving the shuttle mechanism 301 back to the utility station 107 to avoid any accidental dripping of coating material onto the substrate 106. Shuttle mechanism 301 may then be moved to the utility station 108, and another substrate 106 subsequently loaded onto the chuck 201.

In a typical sequence of operations, the head may be moved over a substrate loaded onto chuck 201 to begin coating from the far edge toward the near edge. Of course, substrate 106 may alternatively be loaded after the head has moved to the far end, if desired. Similarly, the head may be returned to a home position, passing over a freshly coated substrate, prior to removal of the substrate from the chuck, if desired.

Alternatively, the sequence is such that the dispensing head 101 is never above a substrate 106 except when performing a controlled coating operation. Of course, in alternative embodiments, such as when a coating fluid is of sufficient viscosity so as not to present a drip hazard, the sequence of head movements may be different than that outlined above.

It should also be appreciated that there is no limitation that the present invention coat the entire surface of the substrate. For example, the motion of the extrusion head may be stopped at some point prior to fully coating a substrate where only a portion of the substrate is desired to be coated. Additionally, or alternatively, the length of the extrusion head may be such that only a portion of the substrate is coated even with full travel of the extrusion head.

In a preferred embodiment of the present invention, the fluid equipment station 107, the dispensing head 101 and all required fluid and control connections between the head 101 and station 107 can be placed on a common apparatus or structure, such as a removable cart which is only temporarily attached to the remainder of coating apparatus 100. When any condition requires a change or servicing of fluids, such as a change in coating material, exhaustion of fluid supply in a fluid equipment station 107, or a change in selection of dispensing head 101, the dispensing head 101 may be returned to the fluid equipment station 107 for convenient proximal placement of all wet components. Moreover, where a removable arrangement is employed, such as the aforementioned removable cart, attachment means securing the fluid equipment station 107 and utility station 108 to the rest of the coating apparatus 100 and control interface attachments between controllers located on the cart and the base station may be removed, and a new cart possessing the desired change of material or equipment, or resupply of fluid, may be attached and thus reform an entire coating apparatus 100. Such an arrangement permits required maintenance and cleaning of the fluid equipment to occur without idling the balance of the equipment in the coating apparatus 100.

In a preferred embodiment of the present invention, a second pumping means in addition to whatever pumping means is present in the fluid equipment station 107 can be installed on the dispensing head for the purpose of accurately controlling the flow rate of coating fluid to the dispensing head 101. Implementation of such a "pump on head" arrangement can permit fluid flow to the dispensing head to start and stop more rapidly and completely, and permit more precise fluid flow control during the coating process.

In a preferred embodiment, a height sensing and adjustment mechanism can be implemented on the shuttle mechanism 301 to fine tune the gap between the dispensing head 101 and the substrate 106 in real time during the coating operation. A sensing means is appropriately zeroed while the head 101 is at the correct height, and a correction signal is subsequently generated whenever the height deviates above or below the preset level. The height sensing means can consist of a rod with a roller base which rolls along the substrate, or a surface parallel to the substrate. Such an arrangement would provide direct linear position feedback reporting the height of the dispenser or dispensing head above the substrate. An alternative means for height measurement would be to measure dispenser height over the substrate based upon the position of the height adjustment motor on the shuttle mechanism 301. Using motor position information for height control constitutes indirect position feedback. Alternative technologies for conducting height sensing include optical sensing, ultrasonic sensing, and electromagnetic sensing. These methods also constitute direct position feedback.

A control system, preferably comprising computer hardware and software, converts the feedback signal into information suitable to drive a motor or other positioning means to restore the dispensing head to the proper height. This process of height self-correction preferably begins at the start of the coating process and continues throughout the coating process. Control of the automatic height correction process can be handled either by main host software or delegated to a control sub-system which performs the height control function without burdening the main host software.

Figure 2A:
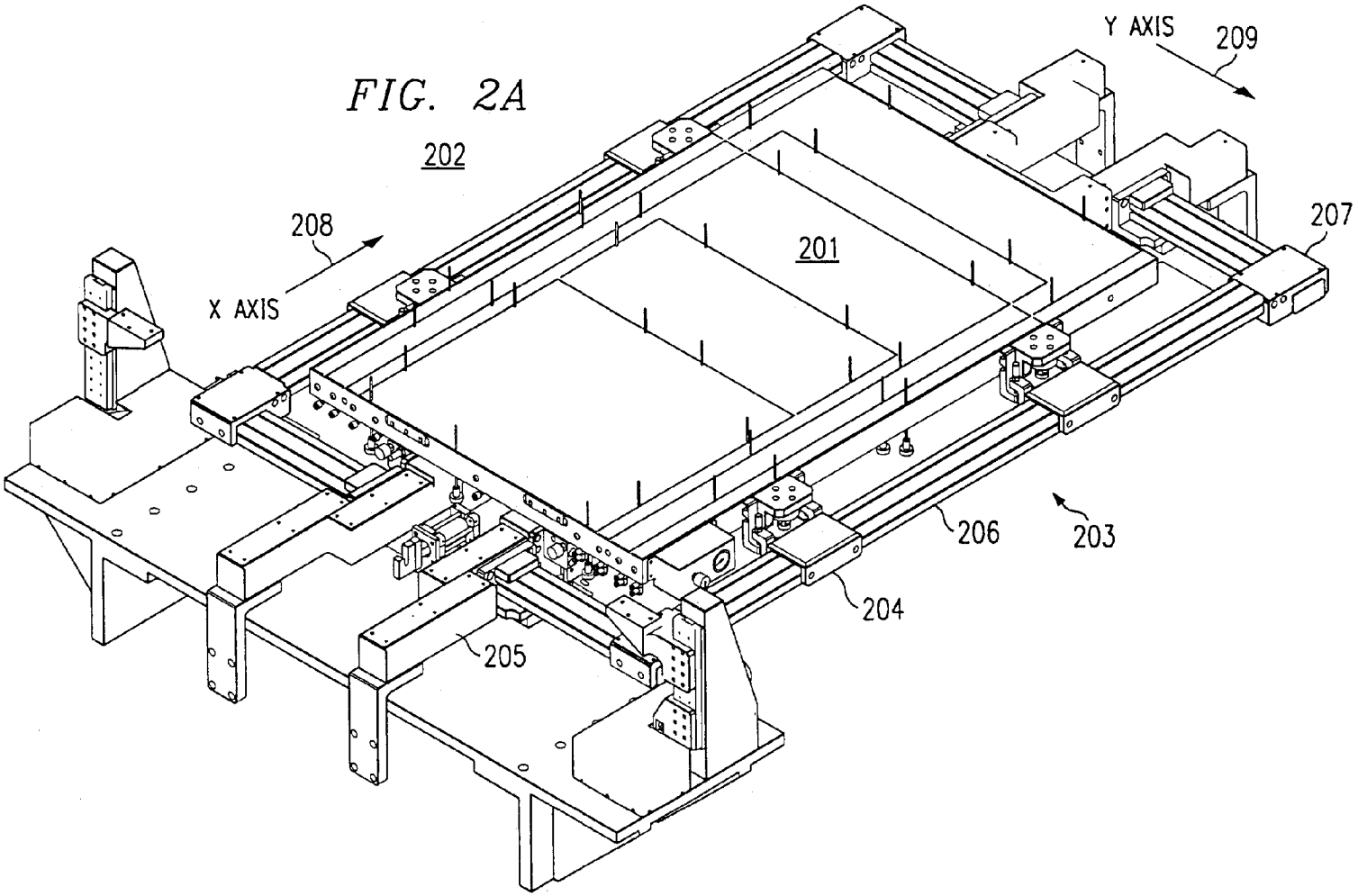
FIG. 2A depicts an isometric view of the chuck holder with chuck in place attached to the coating apparatus according to a preferred embodiment of the present invention.

FIG. 2A depicts an isometric view of the chuck holder 202 holding a chuck 201 in place. The preferred embodiment chuck holder 202 of FIG. 2 is affixed to the coating apparatus via beam structure mounts 205 at four points. The four mounting points are outside the range of travel of the shuttle mechanism 301 so as to permit unhindered operation of the shuttle mechanism 301. The beam structure mounts 205 support the beam structure 203. A plurality, preferably four, chuck mount brackets 204 are attached to a beam 206 of the beam structure 206, preferably as shown in the figure, in a symmetric manner with each chuck mount bracket 204 (the first bracket) located opposite a counterpart bracket 204 on the beam 206 parallel to the beam 206 the first bracket is mounted on. Such a symmetric mounting arrangement helps provide more balanced support for the chuck.

Each beam 206 is linked to another beam 206 at each end by a beam connector 207. The beam connector 207 permits the beams aligned parallel to the direction of travel of the shuttle mechanism (X axis) to be moved so as to expand or reduce the effective width of the chuck holder 202.

Each of the chuck mount brackets 204 may be slidably moved along the beams 206 to which they are attached. The combination of the placement of the X axis 208 beams along the length of the Y axis 209 beams and the placement of the chuck mount brackets 204 along the length of the X axis 208 beams determines the final location of the points of contact between the chuck holder 202 and the chuck 201.

Self centering mating means between the chuck 201 and chuck holder 202 ensures accurate and rigid positioning of the chuck 201. Such mating means preferably consist of a ball joint comprising placement of an inverted cup on the chuck 201 and a ball on each of the chuck mount brackets 204. Alternate embodiments could include a cone and ring mating arrangement or other centering means including grippers or clamps. Of course, more traditional fasteners such as bolts and nuts, may be utilized, if desired.

Once the chuck 201 is mounted on the chuck holder 202, the chuck will be rigidly supported only at the chuck mount brackets 204, which are preferably disposed at the edges of the chuck 201. Accordingly, there will be some downward vertical deflection in the chuck 201 and any substrate 106 located on the chuck 201 at all other points on the chuck surface. Such deflection will increase roughly in proportion with the distance of any point on the chuck 201 from the nearest chuck mount bracket 204 support point. This deflection in the chuck 201 and substrate 106 is designed to accommodate the vertical deflection of the dispensing head 101.

Figure 2B:
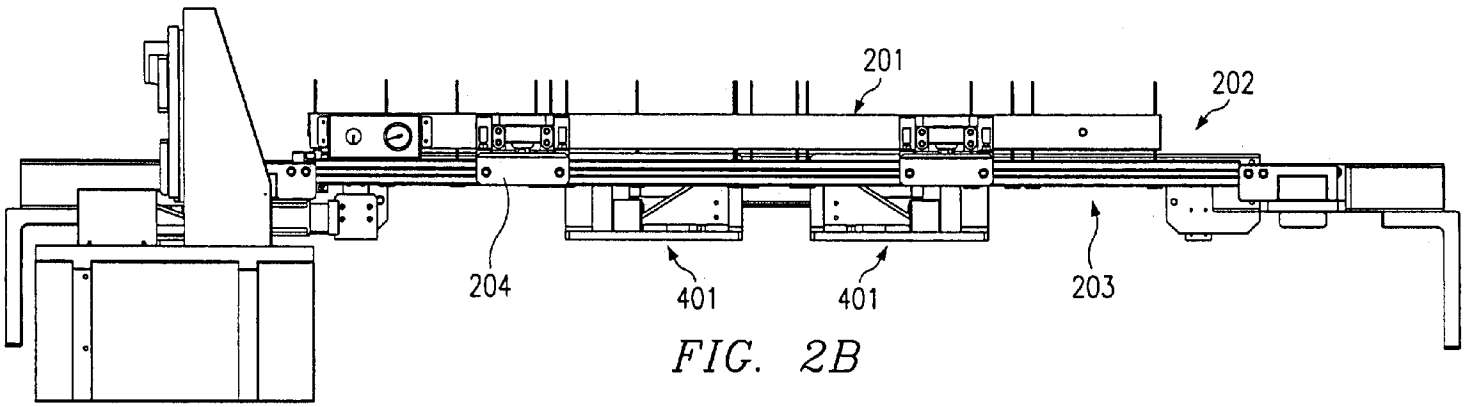
FIG. 2B depicts a side view of the chuck holder with the chuck in place according to a preferred embodiment of the present invention.

FIG. 2B depicts a side view of the chuck 201 on the chuck holder 202. Two chuck mount brackets 204 are visible in this view. The lift plate mechanism 401 is shown protruding below the bottom of the beam structure 203. This figure illustrates the confined vertical space available to the chuck 201 given the need for the shuttle mechanism air bearing 303 of the preferred embodiment to ride underneath the bottom of the chuck 201.

Figure 3:
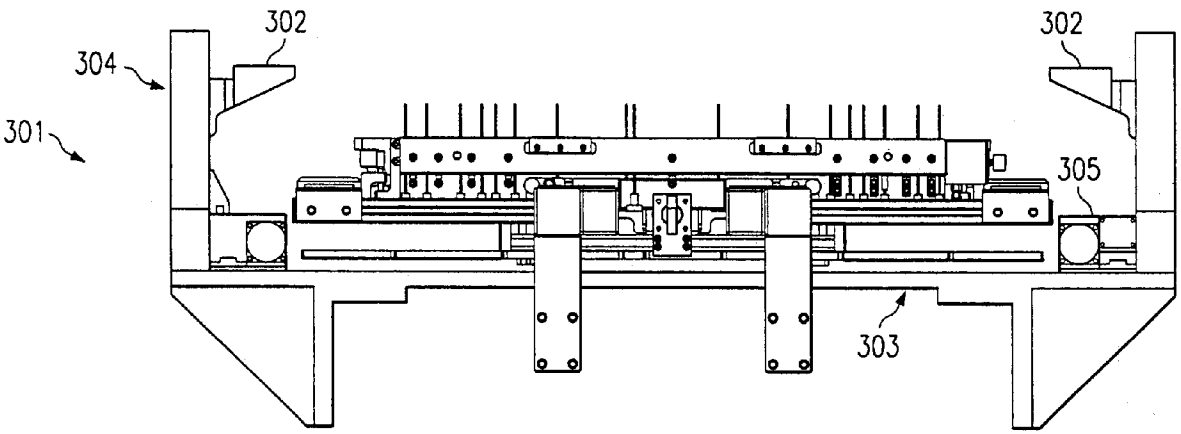
FIG. 3 depicts an elevation front view of the shuttle mechanism according to a preferred embodiment of the present invention.

FIG. 3 depicts the shuttle mechanism 301 according to the preferred embodiment of the present invention. The shuttle mechanism 301 comprises a linear motion interface to provide for linear travel of the shuttle mechanism with respect to the chuck 201. This linear motion interface could comprise, for example, mechanisms suitable for electromagnetic levitation, rolling contact, preferably, with a rail structure, low friction sliding contact, or as in the preferred embodiment, an air bearing 303. The air bearing 303 preferably is attached to the height adjustment mechanism 305 which is in turn attached to the vertical support posts 304. The vertical support posts 304 are each attached to dispensing head attachment means which may comprise, for example, clamps, clips, vacuum grip, magnetic attachment means, or as in the preferred embodiment, head support plates 302 to which the dispensing head 101 may be attached.

The height adjustment system 305 comprises mechanisms for large scale movement of the dispensing head when necessary to move the head 101 clear of any obstruction while redeploying the shuttle mechanism 301 to a different location. The height adjustment system also comprises mechanisms for sensing extremely fine variation of the head height with respect to the substrate, and making correspondingly fine adjustments in the head height in response to sensory information. The height sensing means may comprise, for example, optical, electromagnetic, sonic, air cushion, and ultrasonic, or as in the preferred embodiment, mechanical contact means comprising roller contact.

In a preferred embodiment, a sensor assembly, preferably mounted on the dispensing head, comprises a roller-based rod which drops down to the substrate surface before coating begins. The sensor output is subsequently read and fed into a controller responsible for the head height control motor.

In the preferred embodiment, once the dispensing head 101 is attached to the head support plates 302, the shuttle-head assembly forms a continuous looped structure providing for structural rigidity, and accuracy in the relative positioning of portions of the dispensing head 101 across its own length.

The shuttle mechanism 301, having an air bearing 303 located underneath the chuck 201 boasts a more compact design than if the bearing were located outside the range of the chuck 201, for instance to the left and right respectively of the left and right vertical support posts 304. This more compact design completely envelops the chuck 201 thereby restricting the available vertical space inside the chuck 201.

Figures 4A, 4C:
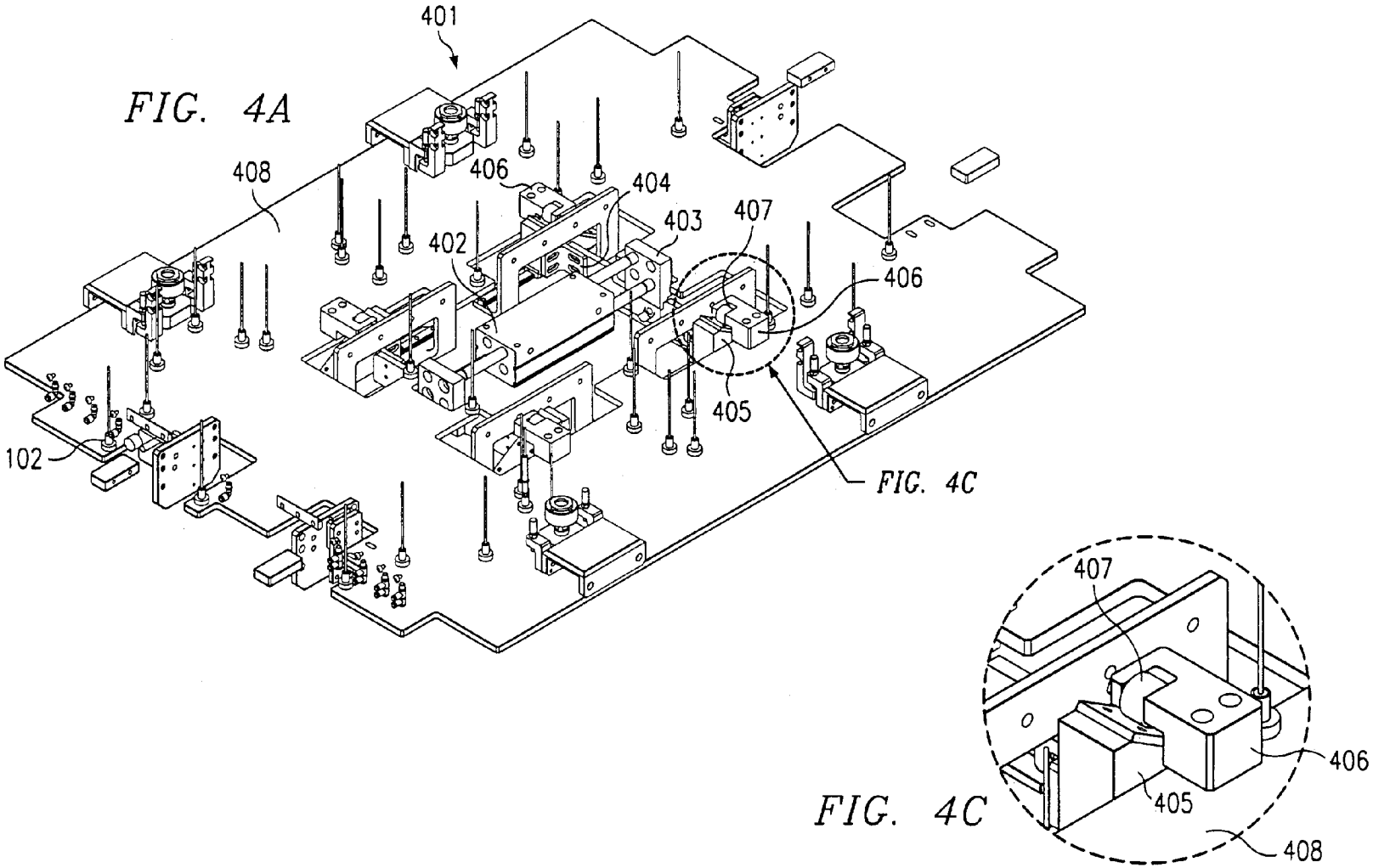
FIG. 4A depicts an isometric view of the lift plate mechanism according to a preferred embodiment of the present invention.
FIG. 4C depicts an expanded view of the cam follower in contact with a tapered wedge according to a preferred embodiment of the present invention.

FIG. 4A depicts an isometric view of the lift plate mechanism 401 of the preferred embodiment. An air cylinder assembly 402 is shown which is preferably rigidly attached to the beam structure 203 (FIG. 2A). As an alternative to air cylinders, displacement means including electromagnetic coils, hydraulic, rack and pinion, or telescoping tubes may be employed. A plurality of, preferably two, members, preferably end arms 403, protrude from the air cylinder assembly 402 each of which is in turn connected to preferably two cam brackets 406 via arm extension brackets 404 which are in turn connected to tapered wedges 405. Each cam bracket 406 houses a cam follower 407 and is preferably rigidly attached to the lift plate 408.

When the air cylinder assembly 402 extends the end arms 403 outward, the tapered wedges 405, having slanted planes, which are attached to the end arms 403 move horizontally with respect to the cam followers 406.

Figure 4B:
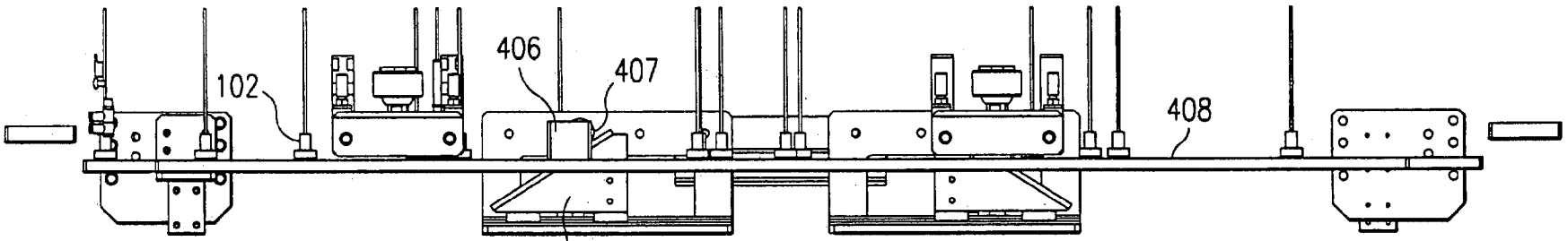
FIG. 4B depicts a side view of a portion of the lift plate mechanism according to a preferred embodiment of the present invention.

Turning to FIG. 4B, it is seen that as each tapered wedge 405 moves horizontally toward its associated cam bracket 406, the slanted surface, or slanted plane, of the tapered wedge 405 will push against the horizontally fixed the follower 407 causing the cam follower 407 to ride up the slanted surface of the wedge 405, and in so doing move vertically upward taking the cam bracket 406 to which it is preferably rigidly attached with it. As the cam bracket 406 rises, the lift plate 408 and lift pins 102 which are preferably fixed with respect to the cam bracket 406 rise the same distance. When the air cylinder assembly 402 retracts the end arms 403, the wedges move back to their starting points, and the cam follower 407, cam bracket 406, lift plate 408 and lift pins 102 drop back down to their lowered positions. This configuration permits considerable vertical motion to be imparted to the lift plate 408 in spite of the restricted vertical space afforded the chuck 201 and correspondingly to the lift plate mechanism 401.

In order to achieve the required vertical lift of the substrate while operating within the constraints of the vertical space allotted to the chuck 201, alternate embodiments might incorporate such mechanisms as telescoping tubes, powered pneumatically, hydraulically, or electrically, or flexible pins which lie horizontally while at rest and get driven into a vertical posture when extended.

Alternate methods of converting motion from a first direction into a different, second, direction could include pushing or pumping air or fluid into a reservoir in communication with a tube oriented in the desired (second) direction which imparts motion to a cylinder within the tube, imparting rotation to a lever arm whose extremity rises in response to rotational motion thereby moving a plate or lift pin in the desired direction, and pushing horizontally on an initially horizontally oriented flexible metal member which is channeled so as to bend toward the desired direction at a predetermined point, thereby imparting motion in the desired (second) direction to a part placed in the direction of travel of the flexible member. Such methods of converting the direction of motion are particularly suitable for situations where, as with the preferred embodiment of the chuck 201, there is substantial limitation in space in one direction but not in others. One motion direction conversion of particular interest is that between horizontal to vertical motion. This is because the preferred embodiment of the chuck 201 has substantial room for horizontal motion, restricted space within the chuck 201 for vertical motion, and a need for a substantial protrusion distance of lift pins 102 out of the chuck.

Figure 5:
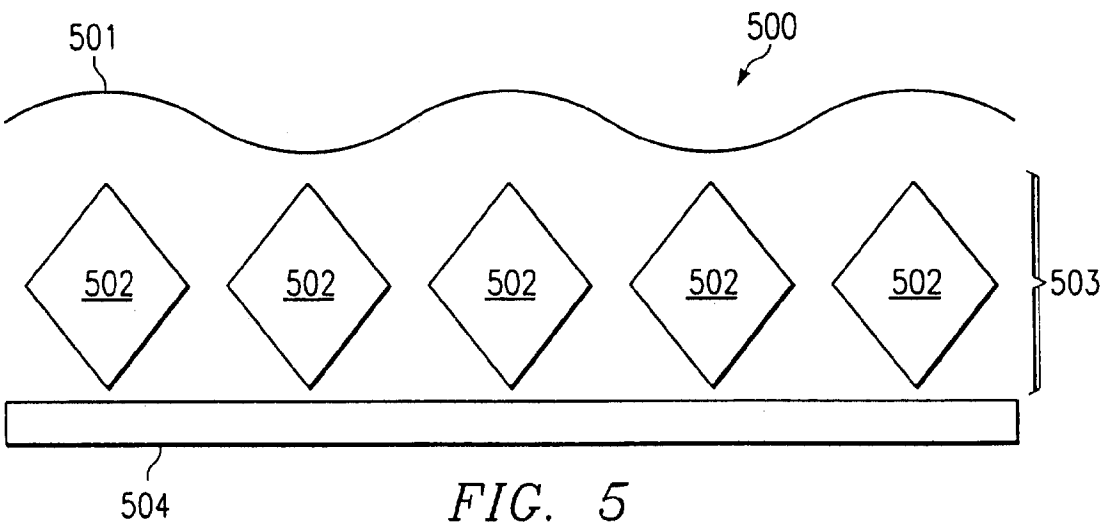
FIG. 5 depicts a cross-sectional view of the micro-deforming chuck.

FIG. 5 depicts a cross-sectional view of a preferred embodiment micro deformable chuck 500, which may be utilized to compensate for irregularities in the substrate to be coated and, thus, present a very level surface for coating. This chuck may be used in combination with the above mentioned head height adjustment to provide superior control over extrusion gap uniformity. Moreover, the above mentioned feedback apparatus discussed with respect to head height adjustment may be utilized in controlling the micro deforming chuck.

The top layer 501 of micro deformable chuck 500 is semi-rigid, while the bottom layer 504 is rigid. The middle layer 503 is composed of piezoelectric crystals 502. When localized voltage potential applied through the bottom of layer 504 is increased or decreased, the piezoelectric layer 503 effects, respectively, the raising or lowering the level of the semi-rigid top chuck layer 501, thereby microdeforming the substrate resting upon the micro deforming chuck. Other methods may be used to deform localized regions of the chuck including changes in the air pressure or hydraulic pressure at specific locations on the micro deforming chuck 500 using an air pump or hydraulic pressure controller. The micro deforming chuck may be used as an alternative or in addition to the automatic height adjustment of the dispenser with the goal of maintaining a constant gap between the dispenser and the substrate, and ultimately maintaining the consistency and quality of the coating bead applied to the substrate. Additionally, the micro-deforming chuck could be used to selectively and locally alter the head to substrate distance. As an example, it could raise the outside perimeter of the substrate to reduce the coating edge bead around the perimeter.

Figure 6:
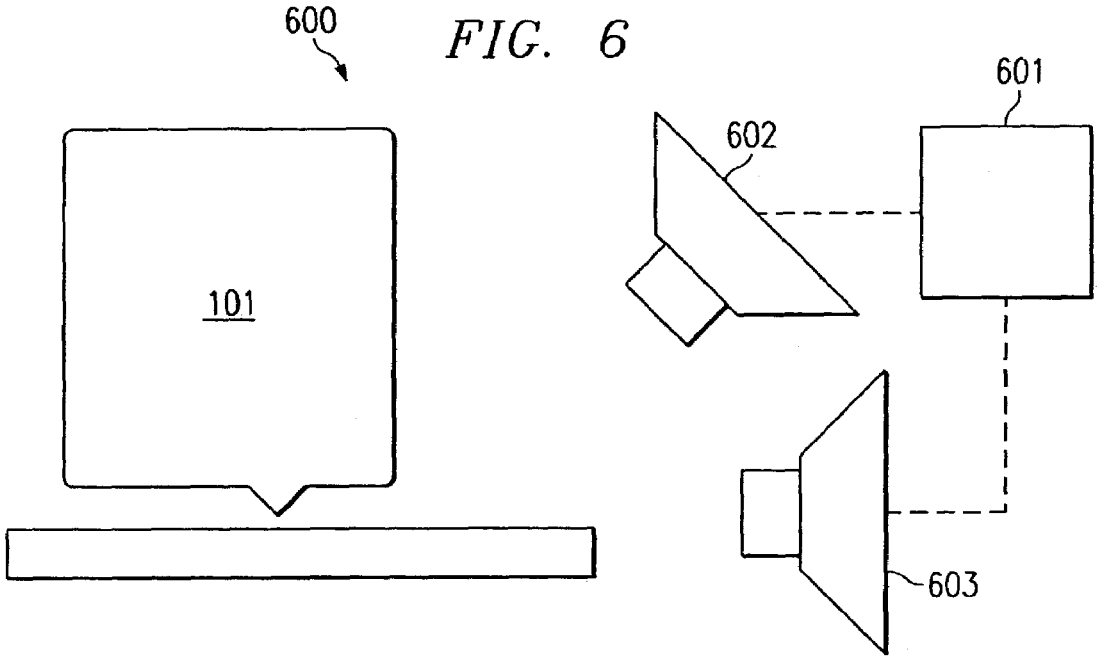
FIG. 6 depicts the sensors used to monitor the level of the subject fluid deposited on the surface of the substrate.

FIG. 6 depicts a preferred embodiment of the sensors used to monitor the level of the subject fluid deposited on the surface of the substrate 106. The Charged Coupled Device camera (hereafter, "CCD camera") 603 tracks the level of the substrate as the dispensing head 101 is dispensing the subject fluid and sends positive reading information to a control system 601. By using the positive reading from camera 603, the control system 601 establishes a range of coordinates across the width of the substrate 106. CCD camera 602 located at an angle above the substrate 106 also sends positive readings to the control system 601. The control system 601 uses positive readings from the CCD camera 602 to generate a range of coordinates along the length of the substrate 106. The control system 601 will then take the coordinate sets and deform the micro deforming chuck 500 as necessary to achieve the desired input surface profile by generating control signals to apply corrective action to selected locations on the chuck. This corrective action may comprise varying the voltage to piezoelectric crystals 502 as in the preferred embodiment of the micro deforming chuck 500. The CCD cameras can be used to measure planar variation in height across the substrate either in real time as the coating process proceeds, or to map the height of the substrate as a function of two horizontal coordinates for the entire substrate and feed this information into the control system for use in a coating operation which begins only after the mapping process is complete, or which moves over substrate area which has been completely mapped even if the entire substrate has not been mapped.

As an alternative to using piezoelectric crystals to effect height adjustment at selected points on the substrate, the control system 601 can vary pneumatic or hydraulic pressure to selected locations on the chuck. In an alternative embodiment, this control system 601 can be integrated into all or part of a filtering and dispensing system for the subject fluid.

Alternative methods for measuring variation in the height of the substrate on the chuck across the plane of the substrate include sensing by sonic, ultrasonic, electromagnetic, or mechanical contact means. A mechanical contact scheme could include deploying a plurality of roller-based rods attached to linear encoders or trailing lever arms attached to rotary encoders spanning the width of the substrate placed at closely spaced intervals so as to be able to determine the planar height variation at closely spaced, albeit, discrete intervals. The axes of the mechanical contact devices may, but need not be aligned. As long as the control system knows where each of the contact devices is on the substrate surface, mapping of the substrate can be accurately accomplished.

For any of the sensing means, when sensing the substrate height in real time (that is, during a coating operation), the position in the direction of travel, of each point on the substrate whose height is being measured, should be even with, or ahead of, the coating device in order to both avoid contamination or altering of the coating and to provide information useful in dispensing the coating.

Figure 7:
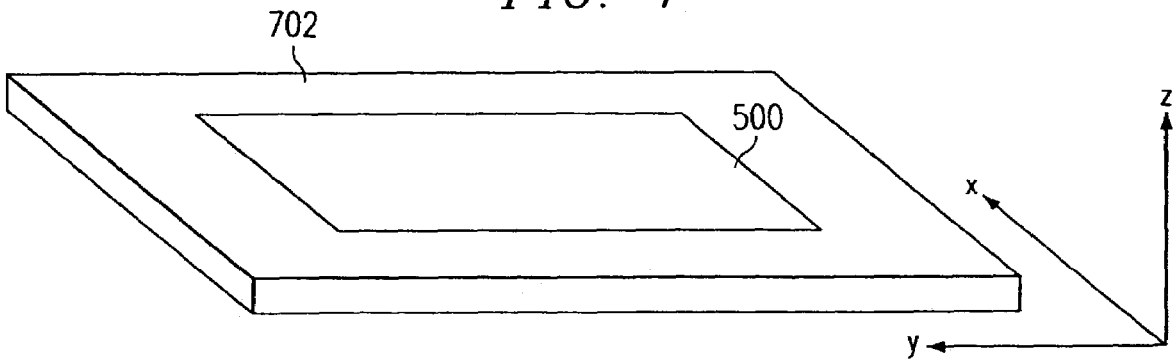
FIG. 7 depicts a movable plate beneath the micro-deforming chuck system.

In addition, as shown in FIG. 7, the entire microdeforming chuck 500 can be repositioned in three dimensions by mounting the micro deforming chuck 500 on top of movable plate 702 that can provide three axes of adjustment to provide for greater adjustment of surface levels of the substrate than are possible with microdeformation of the chuck. The directions of the X, Y, and Z axes are displayed on the figure. The movement of the chuck in the three directions shown can be accomplished by a number of methods including electrical, pneumatic, or hydraulic powered drives or motors.

Implementing a second pumping means on a dispensing head, or extrusion head, can generate certain benefits in the area of fluid control, as the following discussion illustrates. By directly integrating or mounting the micro-dispenser 921 (FIG. 9) upon the extrusion head 800 (FIG. 8), a greater amount of flow control may be maintained during the extrusion process. This in part is due to the amount of fluid volume displaced during the extrusion process. For example, in prior art systems where the main pumping chamber is located remotely from the extrusion head, a greater of volume of fluid must be displaced in order to reach an initial steady-state condition. Primarily, this is due to the greater line distances between the extrusion head and the pump. The requirement (in the prior art) that fluids be delivered over relatively long fluid communication paths is one reason why such prior systems exhibit an initial surge of fluid flow, or a lag in fluid flow, depending on various factors in the apparatus, upon actuation of the pump. This, in turn, has had a tendency to cause edge pertubations in the coating. By mounting a micro-dispensing pump directly to the extrusion head, as in the preferred embodiment of the present invention illustrated above, the amount of process fluid which must be initially displaced to the head itself is minimized, and the dispensing of the fluid is more easily controlled due to the smaller volume of initially displaced fluid that must be provided to the pumping head. Such additional control is particularly beneficial where viscous fluids are being pumped due to the resistance to flow of viscous fluid in long fluid delivery lines.

Figure 8:
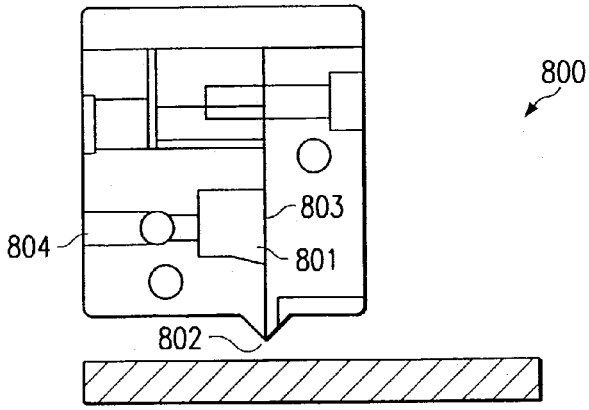
FIG. 8 depicts a cross-sectional view of the slot type head.

FIG. 8 is a greatly simplified cross-sectional view of the slot type head 800. The head 10 is formed from first and second portions that are secured together via one or more fasteners. The head has a fluid manifold 801 or so-called liquid containing chamber and an adjustable orifice or slot 802 in communication with the chamber. The width of the slot is determined by the thickness of a shim 803 located between the first and second portions of the head. The coating liquid is supplied to the extrusion head using a micro-dispensing pump (not shown) to pump fluid into the inlet 804. As seen in FIG. 8, the coating liquid is supplied onto the substrate across the small gap.

Figure 9:
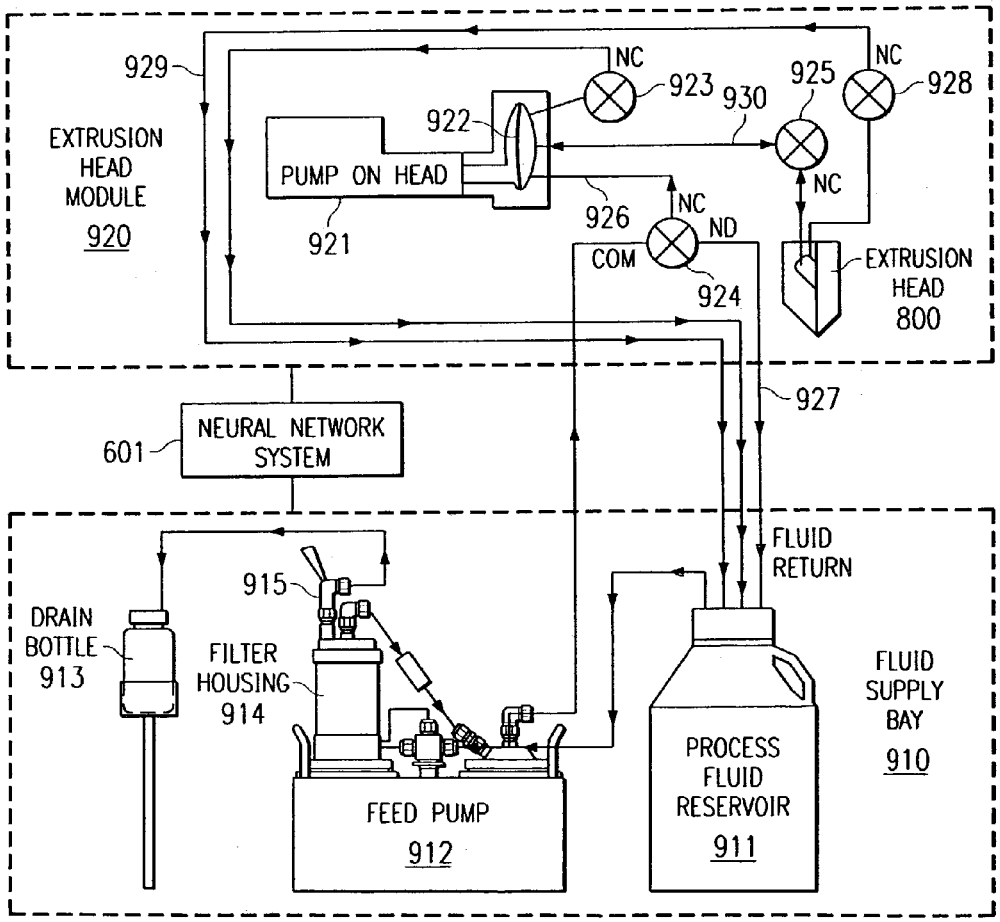
FIG. 9 depicts a plumbing diagram illustrating the flow of fluid through the extrusion mechanism.

FIG. 9 illustrates the elements and interconnections of the fluid supply bay 910 which is remotely located from the dispensing head, as well as the extrusion head module 920 which is integrally mounted to the dispensing head which may be an extrusion head. Even when "remotely located" from the dispensing head, the fluid supply bay 910 is still part of the coating apparatus, and may optionally be disposed on a removably attachable fluid cart. FIG. 9 illustrates the micro-dispenser or "pump-on-head" assembly 921, wherein a pump is directly integrated with the extrusion head for the purposes described herein. Various forms of dispensers may be used in conjunction with pump on head concept, of which the extrusion head 800 is but one example.

Process fluid for deposit on a substrate comes from fluid supply bay 910. The fluid supply bay 910 consists of a processed fluid reservoir 911, feed pump 912, and drain bottle 913. Process fluid to be deposited by the extrusion head 800 is fed from the process fluid reservoir 911 to the feed pump 912 and is then filtered within a filter housing 914. A feed pump useful in the present invention is illustrated by the pump shown in U.S. Pat. No. 5,167,837 to Snodgrass et al, which is hereby incorporated by reference, although other devices may be used as well.

The filtered process fluid is then pumped by the feed pump 912 to the pump-on-head assembly 921 of the extrusion head module 920 so that the fluid may be deposited on a substrate. Excess process fluid received by the feed pump 912 is returned to the reservoir 911, with a small quantity of air and process fluid moving through vent 915.

Figure 10:
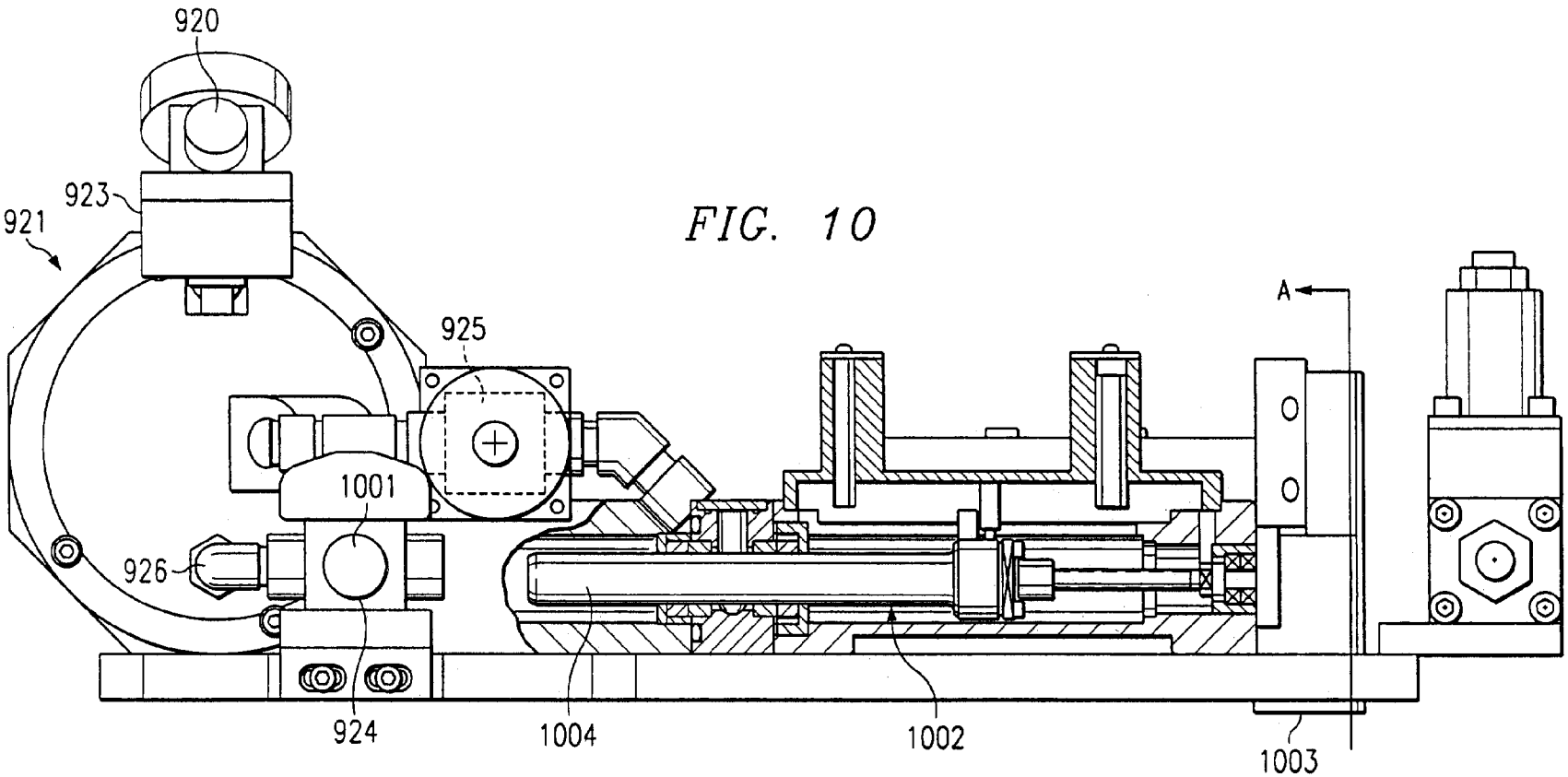
FIG. 10 depicts a partial cross-sectional view of the pump on head apparatus that is integrally connected to the extrusion head.

FIG. 10 depicts a partial cross-sectional view of the preferred embodiment pump on head apparatus that is integrally connected to the extrusion head. Fluid flow from the feed pump 912 (FIG. 9) passes through a three way recirculation valve 924 that routes the fluid flow to either the process fluid reservoir 911 (FIG. 9) in the fluid supply bay 910 (FIG. 9) through output 1001 or to the micro-dispenser 921 through conduit 926. The process fluid is driven through the micro-dispenser 921 by a pump drive means 1002. The pump drive means 1002 comprises a drive motor (not shown) coupled through a transmission assembly 1003 to a positively driven rod and seal arrangement 1004. The rod and seal arrangement 1004 is hydraulically coupled to an internal drive diaphragm 922 (FIG. 9) within the micro-dispenser 921. The drive motor actuates the drive rod 1004 in precise and measurable movements to displace a desired amount of hydraulic fluid. The displaced hydraulic fluid drives the diaphragm 922 (FIG. 9) to displace an amount of process fluid through the micro dispenser 921 to extrusion head 800 or back to the fluid reservoir 911.

Other pumping means could include centrifugal, reciprocating, peristaltic, pressure vessel with precisely regulated pressure and/or flow controls, piston, diaphragm (single, dual, continuous or single shot, and pneumatic or hydraulically activated), gravity feed, and progressive cavity.

The direction of process fluid flow depends on whether or not the extrusion head 800 is in an active or inactive mode and the settings of an isolation valve 925 and vent valve 923. When the head is inactive, the isolation valve 925 closes and the vent valve 923 opens to direct flow of the process fluid back to the process fluid reservoir 911 of the fluid supply bay 910. During active operation, the vent valve 923 closes and the isolation valve 925 opens to direct flow of process fluid out of the micro-dispenser 921 through outlet port 929.

Referring back to FIG. 9, the neural network system, or other control system 601 preferably controls the steady-state fluid flow by monitoring the flow rate at points 926 and 930. Point 926 will measure the flow rate into the pump-on-head assembly 921. To ensure that the system has steady-state flow during the active and inactive periods, the neural network system 601 can control the openings of the recirculation valve 924, the vent valve 923 and/or isolation valve 925 to further control fluid flow. The neural network system can also control the pumping rate in a very precise manner to effect the desired flow rate changes. It is noted here that control schemes other than a neural network can be used.

The micro-dispenser or pump-on-head assembly 921 may also be configured to function as a vacuum pump to withdraw process fluid from the extrusion head and cease providing the process fluid. Otherwise stated, the pump-on-head assembly can supply negative pressure to the extrusion head. This enables an extrusion to be stopped at a more precise point on the substrate than would otherwise be possible and permits fluid flow to be stopped more instantaneously than otherwise possible. In prior art embodiments, the process fluid continued to flow until the extrusion head was emptied or until capillary action halted fluid flow from the extrusion head manifold. An extrusion head vent valve 928 may also be used to vent extraneous process fluid and/or release excess pressure from the extrusion head and limit excess flow. The vented process fluid returns to the process fluid reservoir 911 within the fluid supply bay 910 through a conduit 929. The extrusion vent valve 928 may also be controlled by the neural network to correct fluid flow anomalies that reach the extrusion head pump-on-head assembly.

It is sometimes desirable to dispense fluid only along selected portions, or segments, of the length of a dispenser or dispensing head, wherein the dispenser may be in the form of an extrusion head. A general term for such an operation is segment coating. One example of operation where this would be advantageous would be when a system is called upon to coat a plurality of substrates in a single pass of an extrusion head or other type of dispenser over the substrates without also leaving coating material in the space between the various substrates.

Segment coating could be achieved in a number of ways including cutting multiple slots in a single dispenser which is possibly in the form of an extrusion head. Another approach would be to use a plurality of extrusion heads, or other type of dispenser along the width of the plurality of substrates to be coated. Furthermore, the multiple slot and multiple head approaches could be combined.

Another method for segment coating involves placing an additional part over the exterior of a single extrusion head or other type of dispenser, this additional part containing openings of selected lengths in selected places. In this manner the fluid would be channeled through the openings in the attached part even if the original dispensing head was of a standard single orifice design. A segmented die lip is one such "additional part" with which to achieve segment coating or segmented coating.

FIGS. 11 and 11A show perspective views of the segmented die lip of a preferred embodiment. A segmented die lip will fit over the dispensing slot on the extrusion head which will force the subject fluid to be dispensed through the openings in the die lip. From a perspective view, shown in FIG. 11, the subject fluid flow will be dispensed through the two slots, 1101 and 1103, in the die lip 1100. FIG. 11A shows an inverted view of the die lip, to better clarify the barrier 1102 separating the two slots which ensures that the deposited layers do not interact at the time of deposition. In other embodiments, the die lips can have multiple slots of same or different widths and lengths in order to generate a suitable matrix to most efficiently process the substrate chucks that are in stock. In addition, if the die lip is inadvertently damaged, the down time for the dispensing system will be comparatively short compared to that resulting from damage to the extrusion head assembly, since only the die lip will need to be replaced or repaired.

Figure 12A:
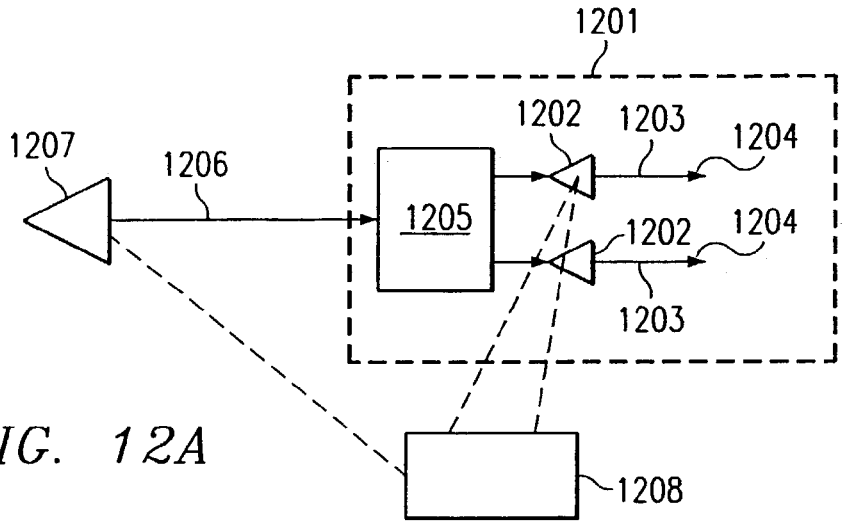
FIG. 12A depicts a preferred embodiment of the slotted extrusion head.

Next, attention is directed to the slotted head option for segment coating. FIG. 12A depicts a preferred embodiment of the slotted extrusion head. FIG. 12 depicts multiple views of the extrusion head module.

Referring now to FIG. 12A, the extrusion head 1201 has two separate slots 1204 for dispensing the subject fluid. There are conduits 1203 running from the liquid containing chamber 1205 in the extrusion head to each of the separate slots 1204. In each of the conduits there is a valve 1202 connected to the neural network which can control the amount of fluid flow to the slots. Fluid flows into extrusion head 1201 through conduit 1206 which is controlled by the isolation valve 1207. Valves 1202 and 1207 are controlled by the neural network 1208. The neural network can therefore be used to control the emissions of the subject fluid so that two different segment types can be formed adjacent to each other on the substrate. FIG. 12 shows that one embodiment of the extrusion head 1201 where a barrier 1209 runs along the extrusion head between the two dispensing slots 1204 so as to ensure no leakage and disturbances crosses-over from the other dispensing slot.

Figure 13A:
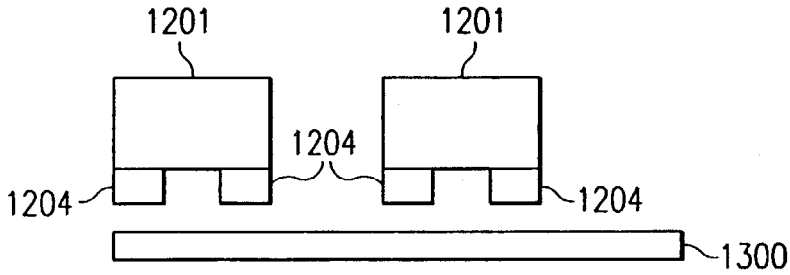
FIG. 13A depicts an end view of a fixed multiple extrusion head coating system over a large area substrate with a moving substrate chuck.

Referring to FIG. 13A, multiple fixed extrusion heads 1201 can be used over a large area substrate 1300. The extrusion heads, in a preferred embodiment, can be fitted with multiple slots 1204 so that segment coating can occur from just the multiple heads or the multiple heads in conjunction with the multiple slots. Such a system can allow for a variety of different sized coatings from the usage of a large-area substrate on a single substrate chuck.

Figure 13B:
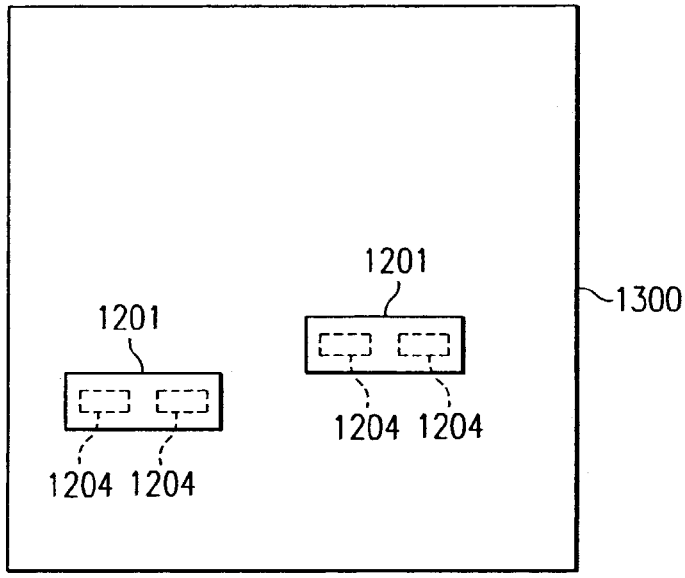
FIG. 13B depicts a top view of a fixed multiple extrusion head coating system containing a setoff between the position of the two heads.

As shown in FIG. 13B, in order to synchronize the sensing feedback mechanics, such as the aforementioned cameras with the priming mechanisms, the extrusion heads can be slightly set off from each other. Such a set-off will help in the calibration of the extrusion heads and will also allow an easier visual indicator of the performance level of each set of extrusion heads. The throughput time for such a system will be very efficient since the display areas on the substrate can be maximized.

Figure 13C:
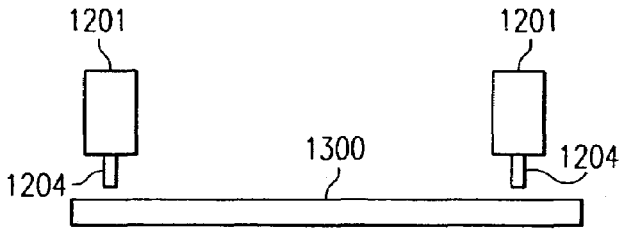
FIG. 13C depicts a side view of a coating system having multiple extrusion heads according to an alternative embodiment of the present invention.

FIG. 13C depicts another system for use in coating multiple areas on a single large-area substrate 1300. This system contains a fixed large-area substrate over which multiple extrusion heads 1201, again with or without multiple slots, make coating runs. In this particular embodiment, two extrusion modules will start on either side of a substrate. They will proceed inward at a staggered interval so that contact at the center will not be made.

FIG. 13C depicts modules that run the length of the substrate, however, other embodiments, dependent on the configuration of the substrate, can include modules that will make one pass to the center and then slide down the length of the substrate to make a pass from the center to the edge, and then slide further down the substrate to repeat the process. These embodiments will be very effective in reducing throughput time since multiple coated areas, such as may be associated with multiple FPDS to be fashioned from a single substrate panel, can be effectively generated over a large area substrate instead of the time-consuming process of individually placing smaller display substrates for coating.

Figure 14:
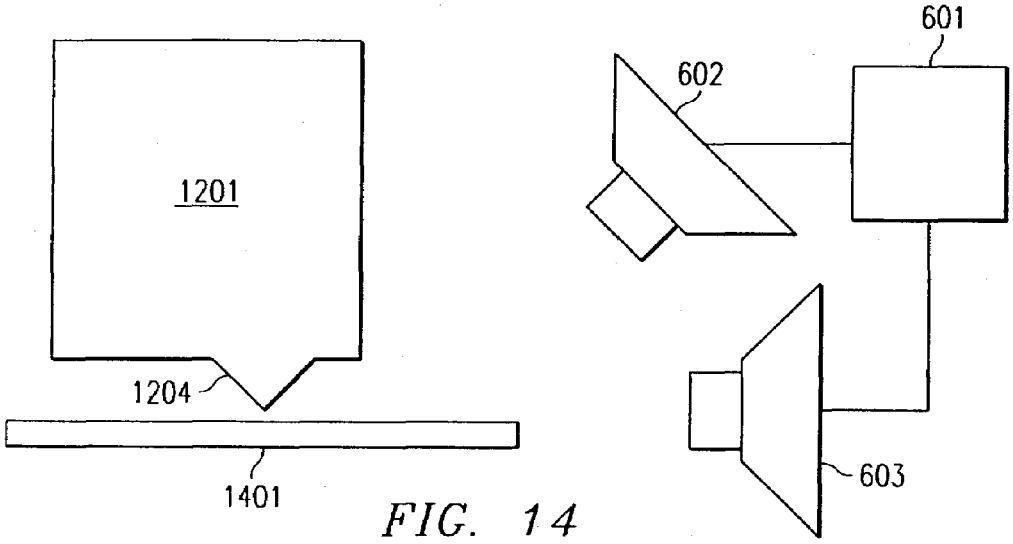
FIG. 14 depicts an illustration of a sensor system configured to observe fluid dispensing at slots in an extrusion head.

In an alternative embodiment, a neural network 601 can also be used to control the beading at the dispenser before its application to the substrate chuck. Referring to FIG. 14, in the instances where a priming mechanism is present to facilitate the establishment of a steady state flow condition on the extrusion head 1201, a CCD camera 603 or other sensory feedback mechanism, which is focused on their respective slot dispenser 1204, is connected to the neural network system 601, and can inform the neural network to repeat the process until the beading is satisfactory such as by either cleaning the extrusion head and re-priming, or applying negative pressure to draw the coating back into the liquid chamber and then re-priming.

Sensors (not shown) on the substrate chuck 1401 or CCD cameras 202 allow the neural network 601 to calibrate the movement of the substrate chuck 1401 or the extrusion head 1201 (depending on which mechanism will be fixed) as the process chemical is applied to the substrate to ensure a smoother distribution on the substrate. In conjunction with the CCD cameras focused on the beading slots, the neural network can ensure that the segmented coating will proceed smoothly by regulating the flow to the slots 1204 by valves 1202 (FIG. 12). Therefore, if an anomaly occurs, the network can shut one valve in order to reprocess an adjoining segment.

Figure 15:
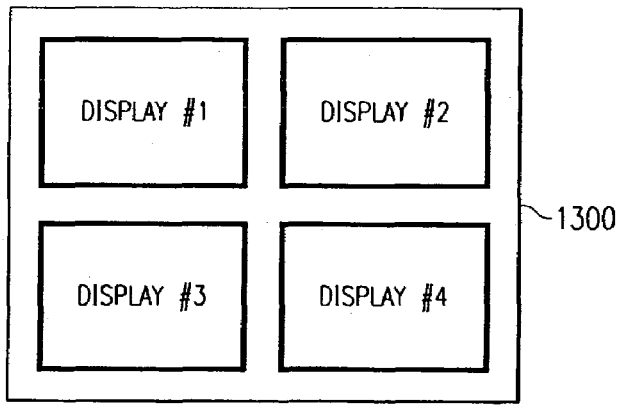
FIG. 15 depicts a one possible matrix from a segmented coating system.

Referring to FIG. 15, the matrix or large area substrate 1300 from a segmented coating system can consist of a two by two matrix (as shown in the FIGURE) or any other matrices that are desired. FIG. 15 demonstrates that segmented coating means, whether employing multiple slot extrusion heads, (whether multiple head or not) or a die lip applied to the outside of an extrusion head, permits coating of a plurality of substrates in a single pass of the extrusion head above the substrates.

Although the present invention and its advantages have been described in detail, it should be understood that various changes, substitutions and alterations can be made herein without departing from the spirit and scope of the invention as defined by the appended claims.

What is claimed is:

1. An extrusion coating apparatus for applying a precisely controlled layer of liquid to a substrate, comprising:

an extrusion bead having a slot that dispenses the liquid onto the substrate;

pumping means integrally mounted to the extrusion head for providing a flow of the liquid to the slot of the extrusion head including means for venting excess air;

a liquid reservoir remotely located from the extrusion head;

a feed pump for moving the liquid from the fluid reservoir to the pumping means mounted on the extrusion head; and a shuttle mechanism supporting the extrusion head.

2. The apparatus of claim 1, wherein the pumping means further comprises means for supplying negative pressure to the extrusion head to withdraw the liquid therefrom.

3. The apparatus of claim 1, wherein the pumping means comprises:

an internal diaphragm for driving the liquid from the pumping means into the extrusion head;

piston means hydraulically coupled to the diaphragm for controlling the amount of the liquid output to the extrusion head; and means for driving the piston means.

4. The apparatus of claim 1, wherein the slot extends substantially the full width of the substrate.

5. An extrusion coating apparatus for applying a layer of liquid to a substrate, comprising:

an extrusion head having a slot moveably located adjacent to the substrate;

a pump assembly integrally mounted on the extrusion head, the pump including means for selectively providing a flow of the liquid to the slot of the extrusion head and onto the substrate and a vacuum through the extrusion head;

a liquid reservoir remotely located from the extrusion head; and a feed pump for supplying the liquid from the liquid reservoir to the pump integrally mounted on the extrusion head.

6. The apparatus of claim 5, wherein the pump comprises:

an internal diaphragm;

piston means coupled to the diaphragm for controlling the amount of the liquid to be output to or withdrawn from the extrusion head; and means for driving the piston means.

7. The apparatus of claim 5, wherein the pump further comprises means for selectively directing received the liquid to be applied to the substrate to the extrusion head or to the liquid reservor remotely located from the extrusion head.

8. The apparatus of claim 5, wherein the slot extends substantially the full width of the substrate.

9. The apparatus of claim 8, wherein the pump further comprises means for venting excess air.

10. The apparatus of claim 8, wherein the pump further comprises means for venting excess air.

11. An extrusion coating apparatus for applying a precisely controlled layer of liquid to a substrate, comprising:

an extrusion head having a slot that dispenses the liquid onto the substrate;

pumping means integrally mounted to the extrusion head for providing a flow of the liquid to the slot of the extrusion head, the pumping means including means for venting excess air and means for selectively directing received the liquid to be applied to the substrate to the extrusion head and alternately to a liquid reservoir remotely located from the extrusion head; and a shuttle mechanism supporting the extrusion head.

12. The apparatus of claim 11, wherein the pumping means further comprises means for supplying negative pressure to the extrusion head to withdraw the liquid therefrom.

13. The apparatus of claim 12, wherein the pumping means further comprises:

an internal diaphragm for driving the liquid from the pumping means into the extrusion head;

piston means hydraulically coupled to the diaphragm for controlling the amount of the liquid output to the extrusion head; and means for driving the piston means.

14. The apparatus of claim 13, wherein the slot extends substantially the full width of the substrate.

15. The apparatus of claim 12, wherein the slot extends substantially the full width of the substrate.

16. The apparatus of claim 11, wherein the pumping means comprises:

an internal diaphragm for driving the liquid from the pumping means into the extrusion head;

piston means hydraulically coupled to the diaphragm for controlling the amount of the liquid output to the extrusion head; and means for driving the piston means.

17. The apparatus of claim 16, wherein the slot extends substantially the full width of the substrate.

18. The apparatus of claim 11, wherein the slot extends substantially the full width of the substrate.

* * * * *